US006850085B2

(12) United States Patent
Sakaguchi et al.

(10) Patent No.: US 6,850,085 B2
(45) Date of Patent: Feb. 1, 2005

(54) REFERENCE VOLTAGE GENERATING DEVICE, SEMICONDUCTOR INTEGRATED CIRCUIT INCLUDING THE SAME, AND TESTING DEVICE AND METHOD FOR SEMICONDUCTOR INTEGRATED CIRCUIT

(75) Inventors: Hideaki Sakaguchi, Tenri (JP); Masami Mori, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 83 days.

(21) Appl. No.: 10/425,666

(22) Filed: Apr. 30, 2003

(65) Prior Publication Data

US 2003/0201788 A1 Oct. 30, 2003

(30) Foreign Application Priority Data

Apr. 30, 2002 (JP) ..... 2002-128968

(51) Int. Cl.[7] ..... Q01R 31/26
(52) U.S. Cl. ..... 324/765; 324/770
(58) Field of Search ..... 324/765, 770, 324/727, 512, 522, 523, 527, 537, 763; 702/117, 118, 124, 183, 189

(56) References Cited

U.S. PATENT DOCUMENTS 6,677,923 B2 * 1/2004 Kajihara et al. ..... 345/89
6,766,266 B1 * 7/2004 Sakaguchi ..... 702/117

* cited by examiner

*Primary Examiner*—David Zarneke
*Assistant Examiner*—Trung Q. Nguyen
(74) *Attorney, Agent, or Firm*—Harness, Dickey & Pierce P.L.C.

(57) ABSTRACT

A testing device for a semiconductor integrated circuit of the present invention includes a differential amplifier array module and tester which determine whether an output voltage of a liquid crystal driver LSI is at a proper level and an expected value voltage generator which generates an expected value voltage in accordance with expected value data to output it to the differential amplifier array module. The expected value voltage generator produces expected value data by interpolation in accordance with incoming expected value data fewer in number than the expected value voltage to be generated, so as to be equal in number to the expected value voltage. This makes it possible to carry out an extremely short time and highly accurate test for output voltages of a device under test (liquid crystal driver LSI).

14 Claims, 10 Drawing Sheets

REFERENCE VOLTAGE GENERATING DEVICE, SEMICONDUCTOR INTEGRATED CIRCUIT INCLUDING THE SAME, AND TESTING DEVICE AND METHOD FOR SEMICONDUCTOR INTEGRATED CIRCUIT

FIELD OF THE INVENTION

The present invention relates to a testing device for a semiconductor integrated circuit in which a plurality of DA converters are included, and output voltages of the DA converters are outputted from the respective output terminals. More specifically, the present invention relates to a testing device including a reference voltage generating device which generates a reference voltage in accordance with incoming reference data.

BACKGROUND OF THE INVENTION

In recent years, technical advances of image display devices has enabled the display of precise CG (Computer Graphics) images, realistic, true-to-life images with high definition, etc. Further, there has been a growing demand for the display of images with more gray scale levels and higher definition.

In a liquid crystal panel, which is a liquid crystal display device, among image display devices, a demand for display images with higher definition is also growing. In response to this demand, a liquid crystal driver LSI which is incorporated into the liquid crystal panel has been advanced for multiple outputs and multiple gray scale levels.

In the liquid crystal panel, for gray scale display, each output means of the liquid crystal driver LSI incorporates a D/A converter to output a gray scale voltage. This operation will be explained below with reference to FIG. 8. FIG. 8 is a block diagram of a typical liquid crystal driver, and particularly, a source driver section which outputs voltages for gray scale display to activate source signal lines of the liquid crystal panel.

The following description will assume that the liquid crystal driver is a source driver LSI; however, it may be a liquid crystal driver including a source driver.

Firstly, in the source driver LSI, digital input data (for example, in case of display with 64 gray scale levels, R, G, B each having 6-bit input data) corresponding to voltages for gray scale display which are outputted to the respective source signal lines of the liquid crystal panel are subjected to sequential sampling in a sampling memory in accordance with a start pulse signal (not shown) transferred from a shift register by a transfer clock CK, and data for one horizontal synchronization period (simultaneously, data for the number of outputs) are picked up and temporarily latched in a hold memory.

Next, the digital input data and the data for one horizontal synchronization period are outputted at the same time by a horizontal synchronizing signal LS, and the digital input data is risen its voltage to the level of a voltage applied to the liquid crystal panel via a level shifter to be transferred to the D/A converter. This D/A converter is placed with each output (e.g. 540 output terminals) of the source driver.

Subsequently, in the DA converter, the voltage for gray scale display, corresponding to the above digital input data whose voltage has been risen, is selected, and the voltage for gray scale display is outputted via an output operational amplifier which is placed with each output and inputted to each source signal line of the liquid crystal panel.

Note that, the voltage for gray scale display (e.g. voltage for 64-levels of gray scale display) is generated in a reference voltage generating circuit (ladder resistor) in accordance with a reference voltage (e.g. V0, V1, . . . , V10, . . . ) inputted from an outside source, and outputted to the D/A converter.

As the above reference voltage generating circuit generally used is a ladder resistor. The ladder resistor will be explained with reference to FIG. 6. FIG. 6 is a schematic diagram of a typical ladder resistor.

In FIG. 6, the ladder resistor has terminals V0 to Vn to input reference voltages from outside of the LSI, and each voltage for n+1-levels of gray scale display is outputted from the two ends of ladder resistors m1 to mn to the D/A converter circuit. In FIG. 6, arrows to the D/A converter circuit is omitted.

Note that, an example of the terminals V0–Vn is given in FIG. 6; however, this is only an example of the terminals.

Thus, the change of a reference voltage value enables a correction in accordance with γ characteristic as described later.

In the reference voltage generating circuit shown in FIG. 8, in the case where the foregoing input display data are 6 bits, 8 bits, and 10 bits, voltages for n=64, 256, 1024 levels of gray scale display are generated, respectively.

Further, with the advance for multiple gray scale levels of the liquid crystal driver LSI, acceptable limits of variation of each voltage for gray scale display are held small, so that a highly accurate measurement is essential for a test of a liquid crystal driver securing this quality. Specifically, it is necessary to carry out a higher accurate test to determine whether all of the voltages for gray scale display, which are outputted from the respective D/A converters of the source driver LSI, are at a proper level within acceptable limits and whether the outputted gray scale voltage values are uniform one another among the D/A converters, each of which is placed with the output terminal.

Under the condition where a power supply voltage of a device under test DUT (Device Under Test) is the same, the improvement in the performance of output terminals from 64-levels of gray scale display to 256-levels of gray scale display requires four-fold accuracy in the measurement.

Referring to FIG. 9, the following will explain a testing method using a liquid crystal driver LSI (source driver LSI) which incorporates m-number of output terminals and n-level gray scale D/A converters to output voltages by selecting from n-number of voltage levels (voltage for gray scale display), as a device under test DUT which is a target device for a test.

FIG. 9 is an example of testing a liquid crystal driver LSI 111 as a device under test DUT (hereinafter, referred simply to as DUT), using a semiconductor testing device (tester) 112.

The tester 112 inputs input signal corresponding to predetermined display data to the DUT 111 and judges whether the output signal outputted from the DUT 11 is at a proper level.

The test system in FIG. 9 causes the DUT 111, i.e. liquid crystal driver LSI to input an input signal (predetermined display data) from RGB input terminals using the tester 112 (In FIG. 9, only the D/A converters (DAC) are described among the components in FIG. 8, and output operational amplifiers and others are omitted.), and to output voltages for gray scale display in accordance with the display data.

First, for example, the lowest voltages for gray scale display outputted from output terminals Y1–Ym of the DAC are inputted by time division to the respective matrix switches whose open/close operation is sequentially controlled in the tester 112. Then, the outputs from the terminals Y1 to Ym are sequentially measured as voltages for 1st level gray scale display by a highly precise analog voltage measuring device 115 included in the tester 112. The measurement results are sequentially stored in a data memory 113 included in the tester 112.

By repeating this operation for n-levels of gray scale, data for all levels of gray scale by all output terminals (m×n-number of data) are stored in the data memory 113.

Data stored in the data memory 113 are subject to a predetermined operation using an operating device 114 which is included in the tester 112 to carry out a uniformity test for determining whether each value of the gray scale voltage for the output terminal and the values of gray scale voltages among the output terminals fall within acceptable limits.

In such a test for a liquid crystal driver LSI (source driver LSI), with the advance of multiple outputs and multiple gray scale levels, the increase in volume of picked-up data increases a data processing time, resulting in a drastic increase in test time.

Japanese Unexamined Patent Publication (Tokukai 2001-99899; published on Apr. 13, 2001) discloses a test system which solves the problem of the increase in test time in the foregoing test system shown in FIG. 9.

A technique adopted in the test system for solving the problem of the increase in test time is that differential voltages between an ideal voltage for each gray scale level and voltages outputted from the respective output terminals found by a differential amplifier array module provided corresponding to each of the output terminals, are determined in parallel using a comparator inside the tester so that an equivalent test to the conventional test is carried out in a short time.

The test system will be explained below with reference to FIG. 10. In FIG. 10, a DUT 121 as a device under test is tested by a tester 122, a voltage generator 123, and a differential amplifier array module 124. Note that, as to the DUT 121 and tester 122, detailed explanations are omitted here because they are the same as the DUT 111 and tester 112.

The voltage generator 123 generates an expected voltage level to be outputted by the DUT 121, i.e. an ideal output voltage. The differential amplifier array module 124 amplifies differential voltages between output signals from the voltage generator 123 and output signals from the output terminals of the DUT 121 and outputs the amplified output voltages to the tester 122. Here, the following will also explain an example of testing method using a liquid crystal driver LSI (source driver LSI) which incorporates m-number of output terminals (Y1 to Ym) and n-level gray scale D/A converters to output voltages by selecting from n-number of voltage levels, as a device under test DUT 121 which is a target device for a test. The The DUT 121 includes m-number of output terminals each of which has a D/A converter (DAC), and as described previously, generates voltages for n-levels of gray scale display in accordance with to the display data. Note that, in FIG. 10, in the DUT 121, output operational amplifiers and others are omitted as in the case of the DUT 111.

First, an input signal corresponding to display data is given from the tester 122 to the DUT 121, and the DUT 121 is caused to operate so as to generate, for example, the same voltages for gray scale display from the m-number of output terminals.

The voltages for gray scale display outputted from the m-number of output terminals are respectively inputted at once (in parallel) to input terminals of differential amplifiers included in the differential amplifier array module 124.

Meanwhile, simultaneously with the input of the gray scale voltages from the respective output terminals of the DUT 121, a value as an expected value voltage for the voltage for gray scale display is outputted from the voltage generator 123 and inputted to another input terminal of an differential amplifier included in the differential amplifier array module 124.

Differential voltages between m-number of voltages for gray scale display outputted from the DUT 121 and the expected value voltage generated in the voltage generator 123, i.e. shift amount from the expected value voltage are amplified by the differential amplifiers. The amplification by the differential amplifiers is carried out for the realization of a highly precise comparative determination of the differential voltages.

The m-number of amplified voltages are outputted respectively from the output terminals of the differential amplifier array module 124 and inputted in parallel to tester channels (1 ch to Mch) of the tester 122.

The tester 122 includes a DC measurement unit for the measurement of DC voltage level with high accuracy and the comparator provided to the foregoing tester channels as means for measuring voltages. The comparator, which is a device for carrying out a functioning test, is less accurate in voltage measurement than the DC measurement unit. Therefore, the comparator usually cannot carry out the highly accurate voltage measurement and comparative determination as described above; however, the amplification of the differential voltages by the foregoing amplifying means allows the comparative determination by the comparator.

Thus, the measurement using the differential amplifier array module 124 realizes a short-time test that is equal in measurement accuracy to or better than the conventional test.

FIG. 7 shows a relation in waveform between the expected value voltage from the voltage generator 123 and the output voltage from the DUT 121 (hereinafter, referred to as gray scale voltage) both of which are inputted to the differential amplifier array module 124.

The gray scale voltage outputted from the DUT 121 causes shift voltages $\Delta V1$, $\Delta V2$, $\Delta V3$ . . . with respect to the expected value voltage. The test for the DUT 121 determines whether these shift voltages $\Delta V$ fall within a predetermined voltage range and determined whether these shift voltages $\Delta V$ have a uniformity by comparison of the voltages between the output terminals with respect to the same level of gray scale.

Further, in the test system disclosed in the above publication, each expected value voltage for the voltages for every level of gray scale display is outputted from the expected value voltage generator 123. As this expected value voltage, an expected value voltage which is preset in the form reflecting the later-described $\gamma$ characteristic specifications and others is operated separately in accordance with an input signal inside a test program in operating means (incorporated in the tester 122), and the operation result is transferred to the expected value voltage generator 123 to output the expected value voltage reflecting the $\gamma$ characteristic.

However, in recent years, with the increase in number of gray scale level, exacting specifications have been provided to a shift voltage ΔV between an ideal output voltage, i.e. expected value voltage for a device under test DUT as liquid crystal driver and an actual output voltage, i.e. gray scale voltage from the liquid crystal driver. Generally, the shift voltage ΔV is defined to be within ±20 mV for specifications of 64-level gray scale and within ±10 mV for specifications of 256-level gray scale. Decrease to ±several mV with further increase in number of gray scale level is a matter of hours.

Further, since the expected value voltage is operated in accordance with the formula preset by γ characteristic specifications and others inside a test program and the operation result is transferred to the voltage generator to output as expected value voltage, a time for the transfer of this operation result data has increased with the increase in the number of gray scale levels.

Specifically, when the output voltage in accordance with the γ characteristic, which is produced by operation inside the test program, is transferred from the tester to the voltage generator, in some cases, the data must be transferred serially with 1 ch for limitation of the number of I/O channels in the tester.

In this case, for example, a dot inverse-capable liquid crystal driver LSI (source driver LSI) for 256-level gray scale display, in which adjoining terminals are activated with alternating current by each pixel (dot) of a liquid crystal panel, requires positive and negative data. Therefore, data for 512-level gray scale display must be transferred.

When 3 minutes is required for the transfer of one data (6 bits or more is necessary for the test of a liquid crystal driver for 64-level gray scale display), 1.5 seconds is required only for the transfer of the expected value voltage.

The number of bits for this transferred data is connected with the measurement accuracy that comes from the accuracy of the reference voltage generator itself. For example, in order to determine ±20 mV, which is a general specification for output variation, a tester needs to be more than tenfold more accurate than a device which determines ±20 mV.

To secure tenfold or more measurement accuracy, it is necessary to increase the accuracy by further 3 bits with respect to 6 bits of display data. As a result, 9 bits (6+3 bits) of transferred data is necessary.

Further, the increase in the number of gray scale levels proportionally accelerate the improvement in measurement accuracy, and how to realize a highly accurate measurement is one of the important problems. Therefore, the improvement in measurement accuracy further increases the number of bits for transferred data, resulting in the increase in time for data transfer.

Actually, when a determination time of the shift voltage is compared with a transfer time of the expected value voltage, the ratio of the determination time and the transfer time is 1:2 to 1:3. The necessity of the improvement in measurement accuracy with the increase in the number of gray scale levels further increases the ratio.

As a result, a time that is not virtually necessary for a test (setting time, etc) becomes longer. This results in the increase in test time, i.e. degradation of test performance.

SUMMARY OF THE INVENTION

An object of the present invention is to provide a reference voltage generating device which can carry out an extremely short-time and high accurate test of an output voltage from a D/A converter as a device under test, a semiconductor integrated circuit including the same, a testing device for a semiconductor integrated circuit, and a testing method for a semiconductor integrated circuit.

A reference voltage generating device of the present invention for generating a reference voltage in accordance with incoming reference data, is characterized by including reference data producing means which produce reference data by interpolation in accordance with the incoming reference data so that the reference data are equal in number to the reference voltage, the incoming reference data being fewer in number than the reference voltage to be generated.

A typical reference voltage generating device is adapted to generate one reference voltage for one reference data, so that a time for generating a required number of reference voltages depends on a time for transferring reference data to the reference voltage generating device.

Therefore, increase in the number of reference voltages to be generated in the reference voltage generating device increases the number of reference data to be transferred to the reference voltage generating device and increases a time for transferring the reference data to the reference voltage generating device. This result in the problem that it takes time to generate a required number of reference voltages.

Consequently, as the above arrangement, by generating a required number of reference voltages from reference data fewer than the required number of reference voltages, it is possible to shorten a time for transfer of reference data to the reference voltage generating device in comparison with the case of transferring the reference data with the same number as a required number of reference voltages. This can reduce a time for the generation of reference voltage.

For example, if such a reference voltage generating device is used for a testing device for testing a target testing object (device under test) in accordance with a reference voltage, it is possible to reduce a test time.

Typically, a time for transferring reference data to the reference voltage generating device is much longer than a time for producing reference data by interpolation inside the reference voltage generating device. On this account, increase in the volume (the number of bits) of reference data further increases a difference between the above times.

Therefore, in the case where the volume of reference data (the number of bits) required for the generation of reference voltage is increased for the improvement in testing accuracy, it is possible to create reference data required for the improvement in testing accuracy in a short time of period by generating reference data corresponding to the reference voltage inside the reference voltage generating device.

This makes it possible to carry out an extremely short-time and highly accurate test for a device under test.

In a device for producing multiple voltage values using a ladder resistor or the like for the reference voltage generating device, the interpolation of the reference data by the reference voltage generating section is linear interpolation.

The linear interpolation by the reference data producing section is carried out, for example, by the following interpolating section.

That is, the interpolating section includes:

subtracting section for calculating a difference between the incoming reference data;

dividing section for dividing an output value from the subtracting means by a number of partitions between the incoming reference data;

multiplying section for multiplying an output value from the dividing means by a proportional value corresponding to reference voltage to be outputted; and adding/subtracting section for adding/subtracting an output value from the multiplying means with respect to the incoming reference data as an interpolating value.

This makes it possible to efficiently carry out the linear interpolation of the reference data by the interpolating section.

Further, a semiconductor integrated circuit, such as liquid crystal driver LSI, as device under test may incorporate the above-arranged reference voltage generating device.

This makes it possible to use the conventional testing device for a semiconductor integrated circuit without change, i.e. a testing device which determines whether an output voltage is at a proper level by amplifying a difference between a reference voltage and a voltage for gray scale display.

Further, a testing device for a semiconductor integrated circuit of the present invention, which determines whether an output voltage of the semiconductor integrated circuit is at a proper level by comparison with a reference voltage separately generated, is characterized by including a reference voltage generating device for generating the reference voltage in accordance with incoming reference data, the reference voltage generating device producing reference data by interpolation in accordance with the incoming reference data so that the reference data are equal in number to the reference voltage, the incoming reference data being fewer in number than the reference voltage to be generated.

According to the above arrangement, the reduction of the time for the transfer of reference data to the reference voltage generating device reduces a time for obtaining an output voltage necessary for the test of the semiconductor integrated circuit. This can drastically reduce the time for the test of the semiconductor integrated circuit.

This can drastically reduce a transfer time of the reference data, in comparison with the case of transferring all of the reference data corresponding to a required number of reference voltage, even when the volume of reference data (the number of bits) is increased for the improvement in testing accuracy.

Therefore, in the case where the volume of reference data (the number of bits) required for the generation of reference voltage is increased for the improvement in testing accuracy, it is possible to create reference data required for the improvement in testing accuracy in a short time of period by generating reference data corresponding to the reference voltage inside the reference voltage generating device.

This makes it possible to carry out an extremely short-time and highly accurate test for a semiconductor integrated circuit as a device under test.

In a device for producing multiple voltage values using a ladder resistor or the like for the reference voltage generating device, the interpolation of the reference data by the reference voltage generating section is linear interpolation.

The linear interpolation by the reference voltage generating device is carried out, for example, by the following interpolating section.

That is, the interpolating section includes:

subtracting section for calculating a difference between the incoming reference data;

dividing section for dividing an output value from the subtracting means by a number of partitions between the incoming reference data;

multiplying section for multiplying an output value from the dividing means by a proportional value corresponding to reference voltage to be outputted; and adding/subtracting section for adding/subtracting an output value from the multiplying means with respect to the incoming reference data as an interpolating value.

This makes it possible to efficiently carry out the linear interpolation of the reference data by the interpolating means.

An integrated circuit for liquid crystal drive, i.e. liquid crystal driver LSI (source driver LSI) as the semiconductor integrated circuit further brings about the following effect.

That is, according to the testing device for a semiconductor integrated circuit, in a test for a liquid crystal driver LSI advancing for multiple outputs and multiple gray scale levels, it is possible to produce reference data by interpolation, considering information on $\gamma$ characteristic specifications of liquid crystal panel, such as the number of gray scale levels and the level number of gray scale display.

Therefore, even in continuous tests for devices of respectively different $\gamma$ characteristics, or in the case where the number of gray scale levels are increased to 256-levels, 1024-levels, for example, it is possible to readily generate a reference voltage corresponding to $\gamma$ characteristic by interpolation. Therefore, even in such case, it is possible to carry out a test within a virtual determination time, without a necessity of considering a time for setting a reference voltage.

Further, with the advance of multiple gray scale levels, improvement in measurement accuracy is required. For example, a product with 1024-levels of grays scale requires a measurement accuracy at least within 1 mV. However, unlike the conventional technique, increase in the volume (the number of bits) of reference data does not drastically increase a test time. Further, in the present invention, the reference voltage is generated inside the reference voltage generating device, thereby improving an accuracy of this voltage value. This enables a marked improvement in measurement accuracy in comparison with the conventional case where the reference voltage is generated in a tester or the like.

The above-arranged testing device for a semiconductor integrated circuit is carried out with the following process of a testing method.

A testing method for a semiconductor integrated circuit of the present invention, which determines whether an output voltage of the semiconductor integrated circuit is at a proper level by comparison with a reference voltage separately generated, is characterized by including:

a reference data producing step of producing reference data by interpolation in accordance with incoming reference data which are fewer in number than the reference voltage to be generated so that the reference data are equal in number to the reference voltage; and a reference voltage generating step of generating the reference voltage in accordance with reference data thus obtained at the reference data producing step.

Further, the interpolation of the reference data at the reference data producing step may be linear interpolation.

Still further, the reference data producing step may include:

a first step of calculating a difference between incoming reference data;

a second step of dividing a value thus calculated at the first step by a number of partitions between the incoming reference data;

a third step of multiplying a value thus obtained at the second step by a proportional value corresponding to reference voltage to be generated at the reference voltage generating step; and a forth step of adding/subtracting a value thus obtained at the third step with respect to the incoming reference data as an interpolating value.

For a fuller understanding of the nature and advantages of the invention, reference should be made to the ensuing detailed description taken in conjunction with the accompanying drawings.

DESCRIPTION OF THE EMBODIMENTS

The following will explain one embodiment of the present invention. Note that, the present embodiment will explain a testing device for testing a liquid crystal driver LSI (m-number of outputs and n-levels of gray scale), which is a kind of semiconductor integrated device, used for a device under test (DUT).

Figure 1:
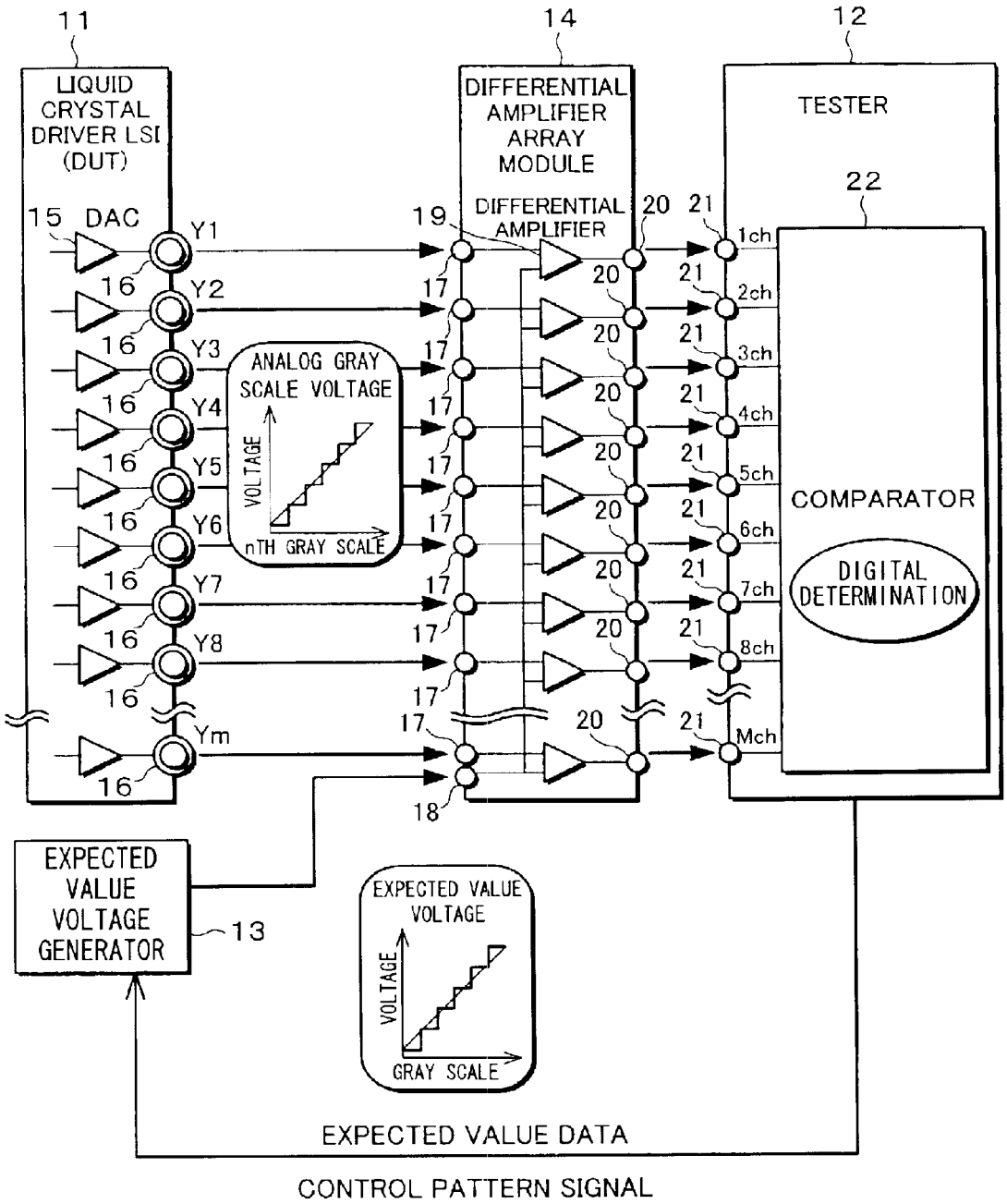
FIG. 1 is a block diagram schematically showing a testing device for a semiconductor integrated circuit according to one embodiment of the present invention.

A testing device for a liquid crystal driver according to the present embodiment will be explained below with reference to FIG. 1. FIG. 1 is a block diagram schematically showing a testing device for a liquid crystal driver.

The testing device for a liquid crystal driver, which determines whether an output voltage of the semiconductor integrated circuit is at a proper level by comparison with a reference voltage separately generated, is characterized by including a reference voltage generating circuit for generating the reference voltage in accordance with incoming reference data, the reference voltage generating circuit producing reference data by interpolation in accordance with the incoming reference data so that the reference data are equal in number to the reference voltage, the incoming reference data being fewer in number than the reference voltage to be generated.

Specifically, the testing device for a liquid crystal driver, as shown in FIG. 1, includes a tester 12 for determining whether an output voltage from a liquid crystal driver LSI 11 as a device under test (DUT) is at a proper level, an expected value voltage generator 13 as a reference voltage generating device (reference voltage generating circuit), and a differential amplifier array module 14.

The liquid crystal driver LSI 11 includes m-number of D/A converters (DAC) 15 and output terminals 16 (Y1 to Ym) which are connected to the respective DA converters 15.

As in the case of the foregoing DUT 111 and DUT 121, output operational amplifiers and others are omitted.

The D/A converter 15 is adapted to output gray scale voltages for n-levels of gray scale.

The liquid crystal driver LSI 11 is adapted to output gray scale voltages, which are incoming from the respective D/A converters 15, in parallel from the respective output terminals 16 to the differential amplifier array module 14.

The differential amplifier array module 14 includes m-number of input terminals 17 to which gray scale voltages are respectively inputted from the liquid crystal driver LSI 11, one input terminal 18 to which an expected value voltage (reference data) is inputted from the expected value voltage generator 13, m-number of differential amplifiers 19, and output terminals 20 which are respectively connected to the differential amplifiers 19. To the differential amplifiers 19, the gray scale voltages from the input terminals 17 and the expected value voltage from the input terminal 18 are adapted to be inputted, respectively.

In the differential amplifier array module 14, each of the differential amplifiers 19 is adapted to find differential voltage between the grayscale voltage and the expected value voltage, and thereafter to amplify the differential voltage so as to output in parallel from the output terminal 20 to the tester 12.

Figure 7:
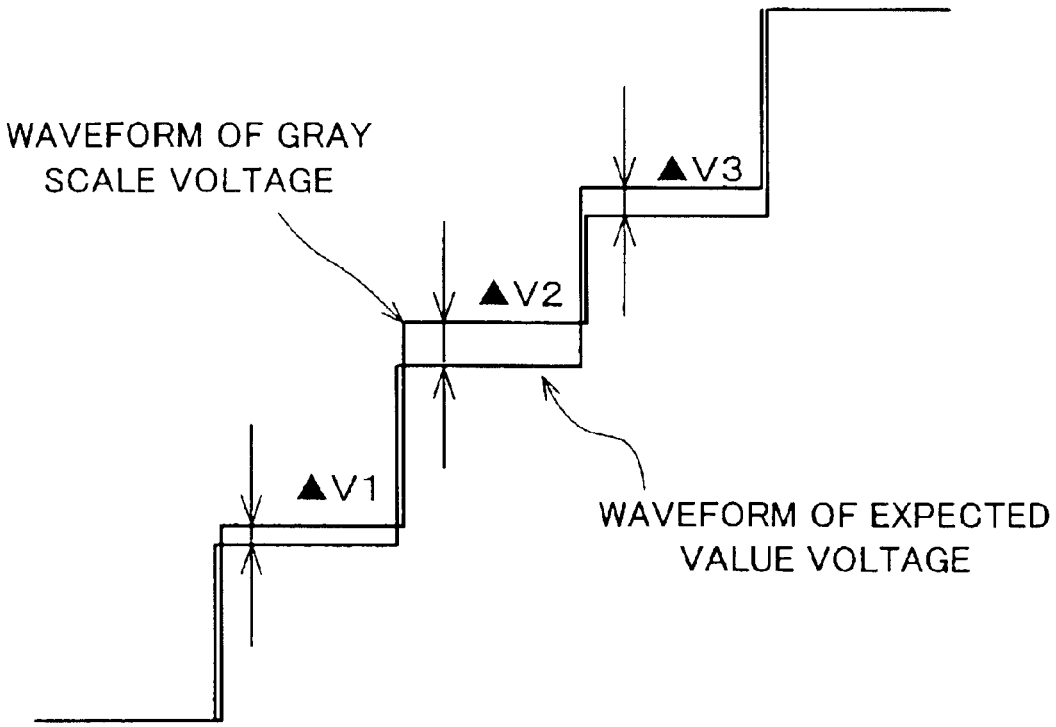
FIG. 7 is a graph showing a waveform of gray scale voltage and a waveform of expected value voltage.
Figure 8:
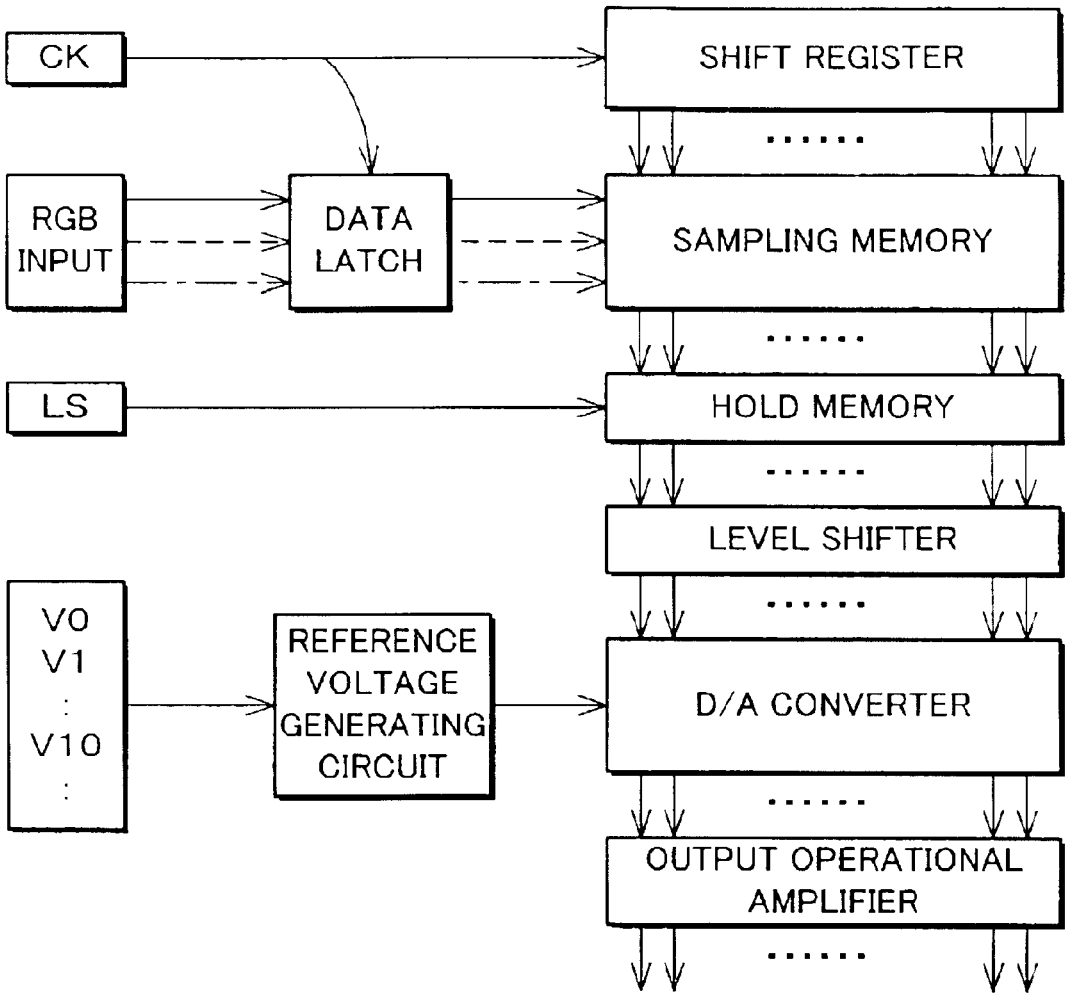
FIG. 8 is a block diagram of a typical liquid crystal driver.
Figure 9:
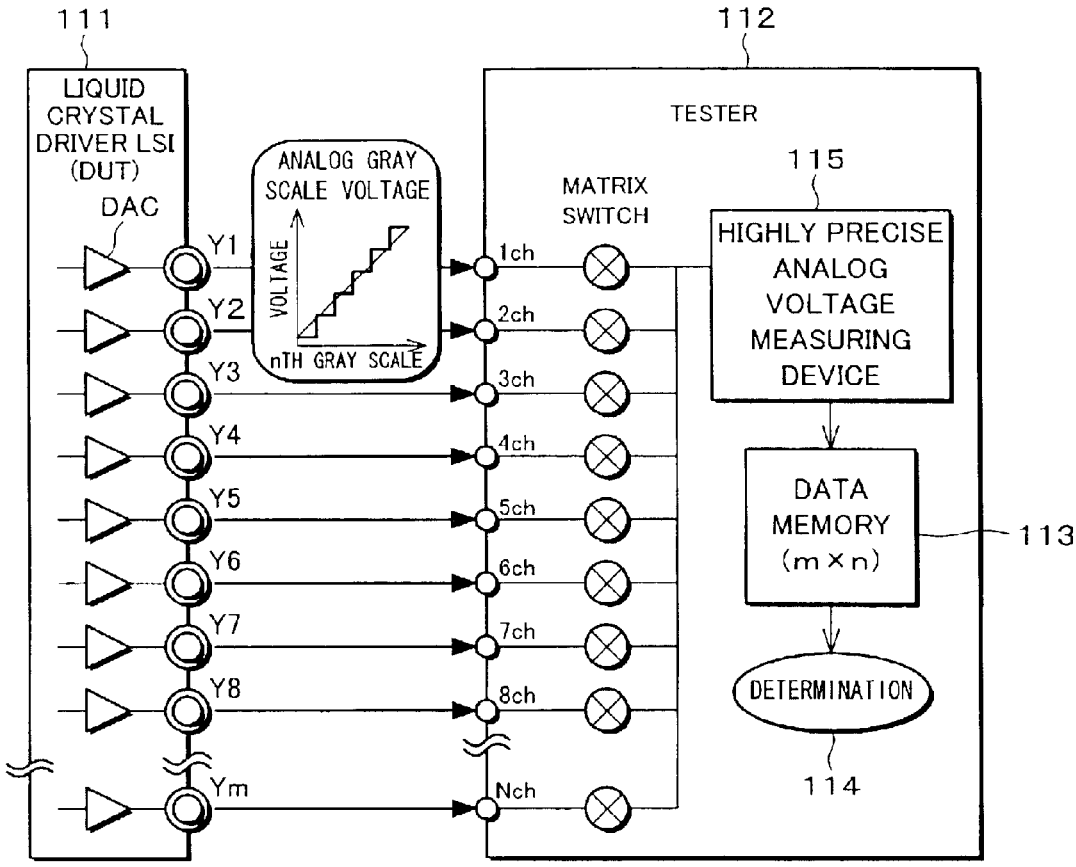
FIG. 9 is a block diagram schematically showing a conventional testing device for a semiconductor integrated circuit.

Here, the operation of the differential amplifier 19 will be explained below with reference to FIG. 7. FIG. 7 is a view showing a relation in waveform between the gray scale voltage and the expected value voltage both of which are inputted to the differential amplifier 19.

Each of the differential amplifiers 19 outputs an amplified output voltage which results from the amplification of the differential voltage (▲V1, ▲V2, and ▲V3 in FIG. 7) between the gray scale voltage outputted from the liquid crystal driver LSI 11 and the expected value voltage outputted from the expected value voltage generator 13 by predetermined times (e.g. hundredfold or more). The amplification of the differential voltage by the differential amplifier 19 realizes a highly precise comparative determination by a comparator 22 in the tester 12 at the subsequent stage.

The tester 12 includes m-number of input channels 21 (1 ch to Mch) to which the differential voltages are respectively inputted from the differential amplifier array module 14, and the comparator 22 which determines whether the differential voltages inputted respectively via the input channels 21 fall within a predetermined range of voltage.

The comparator 22, which constitutes the tester 12, determines at once whether each of the amplified output voltages, which are respectively inputted via the input channels 21 from the differential amplifiers 19, falls within a predetermined range of voltage (e.g. in case of 64-levels and 256-levels of gray scale, the range is ±20 mV or less and ±10 mV or less, respectively, both represented by a value of differential voltage.), and outputs a resultant signal, i.e. a determination result signal indicating whether all of the amplified output voltages fall within the predetermined range of voltage, or any of them is beyond the predetermined range of voltage.

Figure 2:
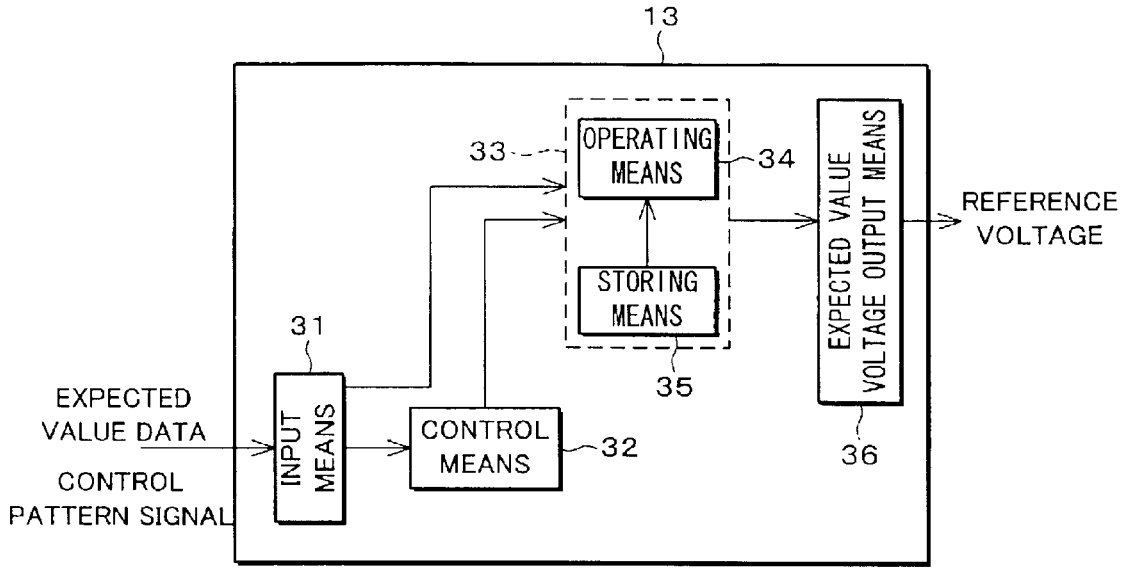
FIG. 2 is a block diagram schematically showing a reference voltage generating circuit inside the testing device for a semiconductor integrated circuit shown in FIG. 1.
Figure 3:
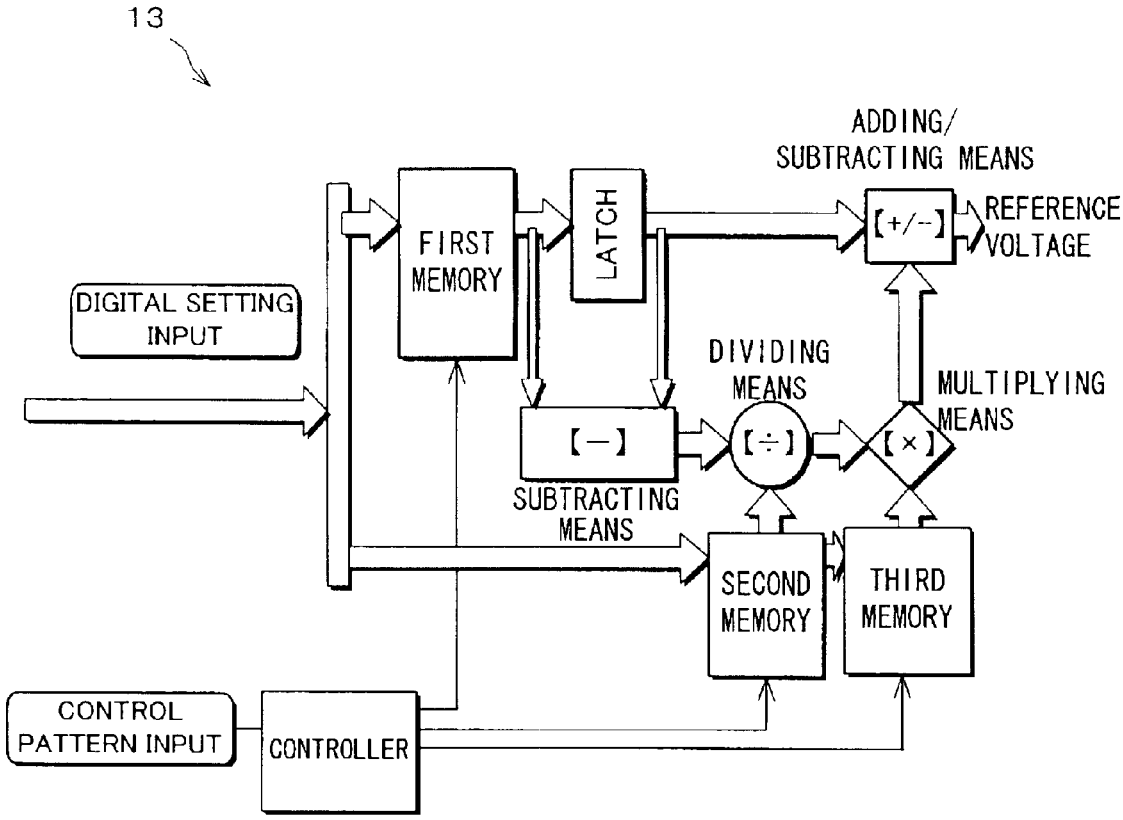
FIG. 3 is a circuit diagram showing one example of the reference voltage generating circuit shown in FIG. 2.

Here, the expected value voltage generator 13 will be explained below with reference to FIGS. 2 and 3. FIG. 2 is a block diagram schematically showing an arrangement of the expected value voltage generator 13. FIG. 3 is a circuit diagram showing a circuit example of the expected value voltage generator 13.

The expected value voltage generator 13 for generating a reference voltage in accordance with incoming reference data is characterized by including reference data producing means which produce reference data by interpolation in accordance with the incoming reference data so that the reference data are equal in number to the reference voltage, the incoming reference data being fewer in number than the reference voltage to be generated.

Specifically, the expected value voltage generator 13, as shown in FIG. 2, includes input means 31 to which expected value data (reference data) and control pattern signal (operation-used set value and control signal) are inputted from the tester 12, expected value data producing means 33 for producing the same number of expected value data as the number of the reference voltages to be outputted by interpolating the incoming expected value data, control means 32 for controlling the expected value data producing means 33 in accordance with the incoming control pattern signal, and expected value voltage output means 36 for producing and outputting a reference voltage in accordance with the expected value data thus produced by the expected value data producing means 33.

The expected value data producing means 33 includes operating means 34 for carrying out a predetermined operation (interpolating process) with respect to the expected value data and storing means 35 for storing the expected value data and operation result. Note that, since many voltage values are adapted to be generated by a ladder resistor (see FIG. 6) inside the liquid crystal driver LSI 11, the interpolating process by the operating means 34 must be a linear interpolation.

In the expected value data producing means 33, the incoming expected value data are digital data, and the storage and operation are carried out with the expected value data in the form of digital data. Consequently, after the reference voltage is produced in the expected value voltage output means 36, the reference voltage is subjected to D/A conversion so as to be outputted as an expected value voltage to the differential amplifier array module 14.

Note that, after producing the reference voltage in accordance with the expected value data, the expected value voltage output means 36 may just cause buffer means to store the reference voltage and output the reference voltage in the form of digital data to the differential amplifier array module 14. In such a case, a D/A converter may be provided between the input terminal 18 and the differential amplifier 19 in the differential amplifier array module 14.

FIG. 3 shows one example of a specific circuit configuration in the case where a linear interpolation is carried out in the above-arranged expected value voltage generator 13. In FIG. 3, a digital setting input indicates an input of data on the expected value data from the tester 12 shown in FIG. 1, and a control pattern input indicates an input of the control pattern signal from the tester 12. Further, a controller corresponds to the control means 32 in FIG. 2. The above expected value data are inputted to the expected value voltage generator 13 in the order of gray scale level.

In the expected value voltage generator 13, the expected value data are inputted to a first memory. The expected value data stored in the first memory are stored temporarily in a latch at the subsequent stage as well as are transferred to subtracting means [−] at the subsequent stage. The expected value data are stored in the latch until another expected value data on the subsequent level of gray scale are inputted to the first memory.

The subtracting means find a difference between the expected value data from the first memory and expected value data stored in the latch, and the resultant difference is transferred to dividing means [/] at the subsequent stage. Here, the expected value data transferred from the latch to the subtracting means are different in gray scale level from the expected value data transferred from the first memory to the subtracting means.

Meanwhile, the expected value data stored in the latch are also transferred to adding/subtracting means [+/−] at the subsequent stage. Adding/subtracting operation in the adding/subtracting means [+/−] will be described later.

In a second memory stored is the number of gray scale levels (the number of partitions) between both of the expected value data, among data on the expected value data transferred from the tester 12. The number of gray scale levels is transferred to the dividing means.

Therefore, the dividing means divide the data transferred from the subtracting means at the previous stage by the number of gray scale levels between both of the expected value data, which is stored in the second memory, and transfer the result to multiplying means [×] at the subsequent stage.

Further, in a third memory stored is a proportional value (the level number of gray scale display) corresponding to the reference voltage to be outputted, among data on the expected value data transferred from the tester 12. This proportional value is transferred to the multiplying means.

Therefore, the multiplying means multiply the data from the dividing means by the proportional value corresponding to the reference voltage, which is stored in the third memory, and transfer the result to the adding/subtracting means at the subsequent stage.

The adding/subtracting means add/subtract the value obtained in the multiplying means with respect to the expected value data transferred through the latch from the first memory, and output this result as a reference voltage to the differential amplifier array module 14 Note that, the adding/subtracting means carry out either adding or subtracting operation in accordance with a voltage for gray scale display.

The subtracting means, dividing means, multiplying means, and adding/subtracting means constitutes interpolating means for interpolating the reference data, and the interpolating means are arranged most suitable for the realization of linear interpolation.

Therefore, a testing method in the above-arranged testing device for a liquid crystal driver is carried out as follows.

A testing method for a semiconductor integrated circuit, which determines whether an output voltage of the semiconductor integrated circuit is at a proper level by comparison with a reference voltage separately generated, includes:

a reference data producing step of producing reference data by interpolation in accordance with incoming reference data which are fewer in number than the reference voltage to be generated so that the reference data are equal in number to the reference voltage; and a reference voltage generating step of generating the reference voltage in accordance with reference data thus obtained at the reference data producing step.

The following will explain a testing operation in the testing device for a liquid crystal driver. Here, the liquid crystal driver LSI (source driver LSI) as a device under test assumes to have, for example, a characteristic as y characteristic example 1 shown in FIG. 5(*a*). The following will explain by an example of producing an output voltage for the 5th level of gray scale in the expected value voltage generator 13 for the purpose of testing an output voltage for 5th level of gray scale in the case of a test of output characteristics from a horizontal axis 1 (1st level of gray scale) to a horizontal axis 2 (17th level of gray scale) in γ characteristic example 1 of FIG. 5(*a*).

The expected value voltage generator 13 sets a reference voltage so that a voltage for gray scale display of the γ characteristic example 1 is produced. This reference voltage may be outputted from the tester 12 or a voltage generator that is separately provided.

To the liquid crystal driver LSI 11, display data corresponding to the 5th level of gray scale are inputted externally from input terminals (not shown) for the display data. With this arrangement, voltages for 5th-level gray scale display are outputted from the output terminals 16 Y1 to Ym to the liquid crystal panel of the liquid crystal driver LSI 11.

Meanwhile, the following operation is carried out under the control of the control means 32, to which the control pattern signal (operation-used set value and control signal) is inputted from the tester 12 through the input means 31 in the expected value voltage generator 13.

Figure 5:
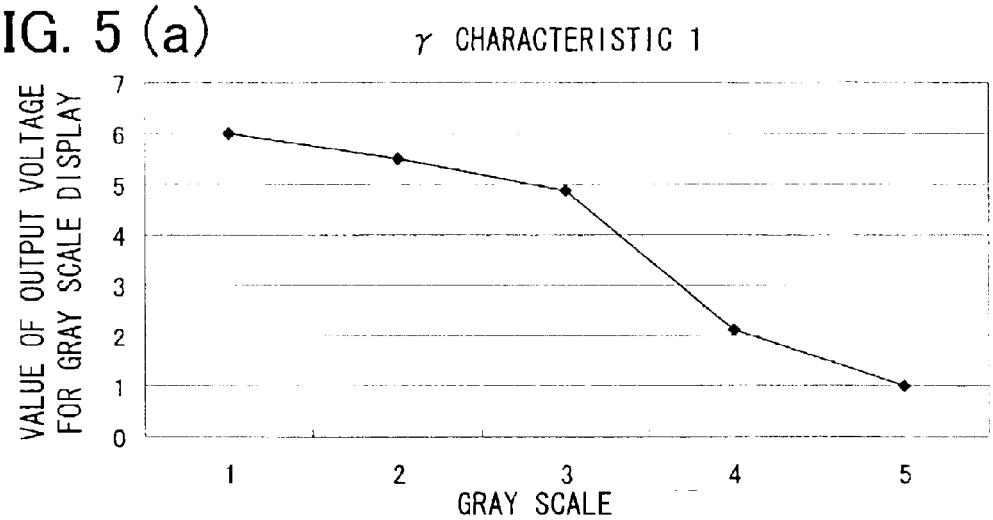
FIGS. 5(*a*) to (*c*) is a graph showing γ characteristic example.
Figure 5:
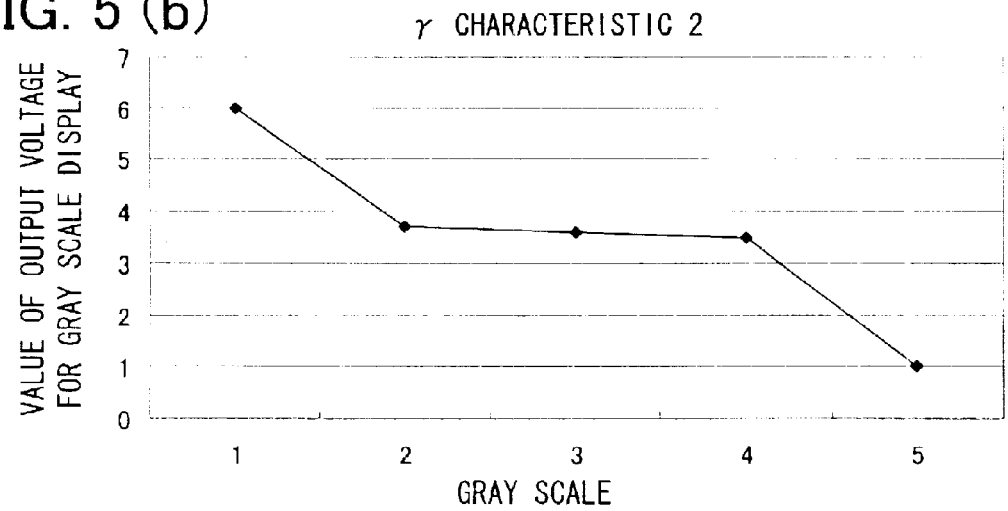
Figure 5:
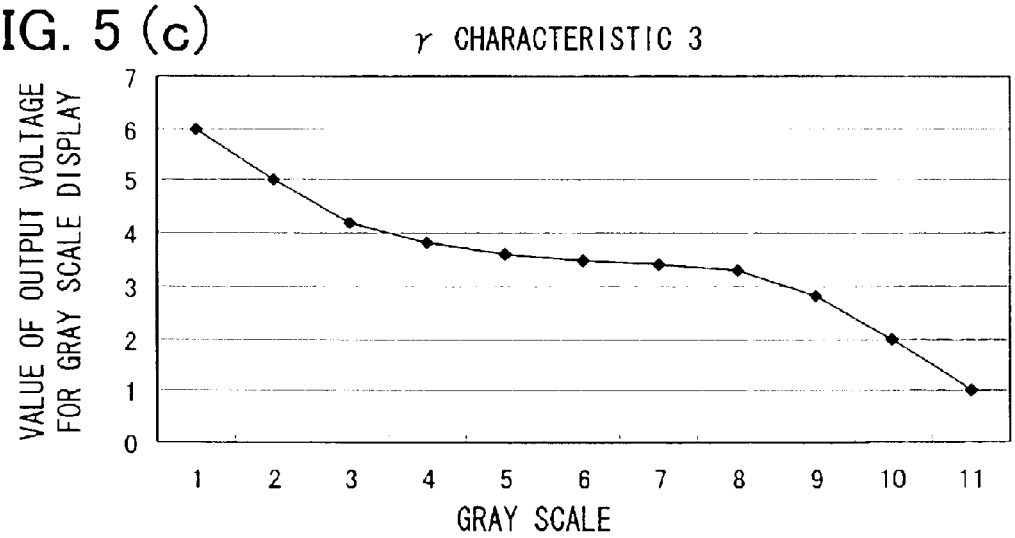

First, digital reference value data D1 corresponding to 6V output voltage at the 1 st level of gray scale (horizontal axis 1 in FIG. 5(*a*)) are inputted via the input means 31 from the tester 12 (digital setting input), and it is stored in the first memory as well as latched into the latch circuit.

Next, digital reference value data D16 corresponding to 5.5V output voltage at the 17th level of gray scale (horizontal axis 2 in FIG. 5(*a*)) are inputted via the input means 31 from the tester 12 (digital setting input), and it is stored in the first memory.

Then, the subtracting means ([−] in FIG. 3) calculate a differential voltage L between the latched digital reference value data D1 and the digital reference value data D16 that just has been inputted and stored, and a calculated value of the differential voltage is transferred to the dividing means ([/] in FIG. 3).

Meanwhile, to the second memory inputted via the controller is the number of gray scale levels J1 between the horizontal axes 1–2 (here, J1=16) of FIG. 5(*a*) as a control pattern signal.

Similarly, the number of gray scale levels Ji between horizontal axes 2–3, horizontal axes 3–4, and horizontal axes 4–5 in FIG. 5(*a*) is stored (here, as in the case of J1, J2=J3=J4=16).

Further, in the third memory stored is a value 5 indicating that the level number of gray scale display H to be tested currently is the 5th level of gray scale. This value assumes to be stored as a control pattern signal through the controller in the third memory.

The differential voltage L calculated in the subtracting means is divided by the number of gray scale levels J in the dividing means ([/] in FIG. 3) to calculate L/J. Here, L/J=(6V−5.5V)/16 is calculated.

Then, the L/J is transferred to the multiplying means ([×] in FIG. 3). In the multiplying means, the L/J is multiplied by the level number of gray scale display H as proportional value corresponding to a reference voltage to calculate L×H/J.

Here, it is H=5 because the gray scale display number H is 5th gray scale, and L×H/J=(6V−5.5V)×5/16 is calculated.

Subsequently, the L×H/J is transferred to the adding/subtracting means ([+/−] in FIG. 3). In the adding/subtracting means, the L×H/J is subtracted from the digital reference value data D1 that has been latched previously to produce an expected value voltage (digital data) for 5th gray scale, and the produced expected value voltage value is converted into an analog expected value voltage value by the D/A converter.

Note that, since the higher voltage between both of the gray scale voltages (e.g. 6V) is a reference here, and the adding/subtracting means operate as subtracting means. However, when the operation is started in accordance with the lower voltage between gray scale voltages (e.g. 1V) as a reference, the adding/subtracting means may operate as adding means.

Outputting the analog expected value voltage value obtained as described above to the differential amplifier array module 14 in FIG. 1 enables the test for the output voltage for the 5th level of gray scale.

Thus, the output voltage from each output terminal 16 in the liquid crystal driver LSI 11 is sequentially tested. Then, tests are repeated while the display data and the level number of gray scale display H are changed. Next, by shifting to the subsequent horizontal axes k–(k+1) in FIG. 5(*a*) and carrying out similar tests, it is possible to test output characteristics of the output terminals 16 for voltages for all levels of gray scale display in the liquid crystal driver LSI 11.

Note that, a change in the number of gray scale J and digital reference value data Di enables γ correction for different liquid crystal drivers LSI 11.

In the present embodiment taking output characteristics of the liquid crystal driver LSI for example, data for both ends of linear characteristic are inputted and the intermediate output values between the ends are interpolated. In case of broken line characteristic, it may be arranged so that data for three points or plural data are inputted and calculated linear portions are interpolated.

Further, FIG. 3 shows a mode in which the number of gray scale levels J and the level number of gray scale display H that is currently interested are stored in the second memory and third memory, respectively. Instead, the third memory may be a counter (here, 16 counter) in which digital data of 1, 2, . . . , 16, 1, 2, . . . are outputted by counting a separate clock.

Figure 4:
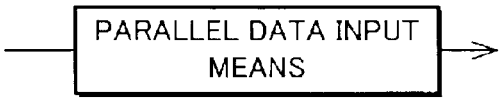
FIGS. 4(*a*) to (*d*) is a block diagram showing input means which are applied to reference voltage generating circuit shown in FIG. 2.
Figure 4:
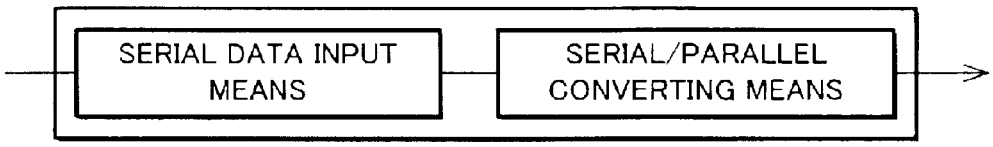
Figure 4:
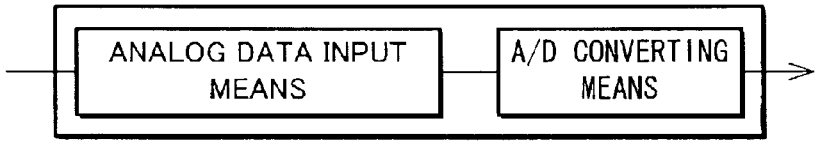
Figure 4:
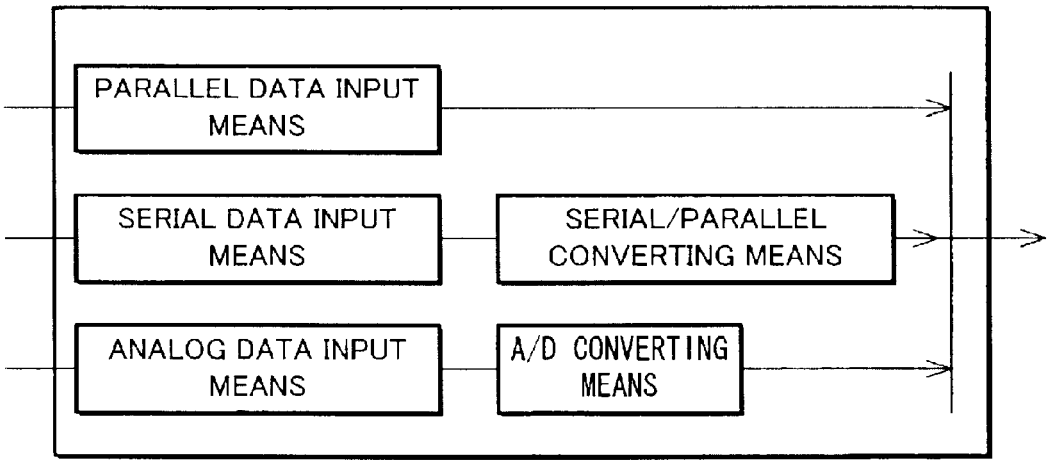

Next, examples of input/output operation and process in the expected value voltage generator 13 will be explained below with reference to FIGS. 4(*a*) to (*d*). FIGS. 4(*a*) to (*d*) show four examples of the input means 31 shown in FIG. 2, respectively. In all the examples, an outputted end is the control means 32 in the expected value voltage generator 13. Note that, the input means 31 is not limited to these four examples.

FIG. 4(*a*) shows an example using parallel data input means as the input means 31. In this case, the expected value data and control pattern signal are inputted in parallel from the tester 12 to the parallel data input means, and they are subjected to signal processing in parallel inside the expected value voltage generator 13. Therefore, it is possible to perform a process at a high speed in the expected value voltage generator 13.

FIG. 4(*b*) shows an example using serial data input means and serial/parallel converting means which are connected serially. This arrangement assumes the case when only one channel can be used for I/O of the tester 12. In this arrangement, the expected value data and control pattern signal are received as a serial signal and subjected to serial/parallel converting process, and thereafter, subjected to parallel processing in the circuit of the expected value voltage generator 13 shown in FIG. 3.

FIG. 4(*c*) shows an example using analog data input means and A/D converting means which are connected serially. In this case, the expected value data is received as an analog signal, converted into a digital signal, and processed in the circuit of the expected value voltage generator 13 shown in FIG. 3.

FIG. 4(*d*) shows an example using all of the input means shown in FIGS. 4(*a*) to (*c*) which can be changed over. That is, this arrangement is adapted to support the above three modes in the expected value voltage generator 13.

In FIG. 4(*d*), for example, in the case when a tester with a sufficient number of channels CH is used, the mode is changed over to a high speed mode of processing without change using the parallel data input means, as shown in FIG. 4(*a*). In the case when a tester with a little number of channels CH is used, the mode is changed over to a mode of receiving in the serial data input means and being subjected to internal serial/parallel conversion using only one CH, as shown in FIG. 4(*b*). In the case when analog data produced in the tester is inputted, the mode is changed over to a mode of inputting analog data and being subjected to internal A/D conversion, as shown in FIG. 4(*c*).

Thus, the change-over of the modes may be carried out according to a tester's characteristic. For this change-over, a mechanical switch may be used, or it may be arranged in such a manner that a type of the signal inputted from the tester (parallel data, serial data, or analog data) is automatically discriminated at the input stage of the input means 31 so that a mode is automatically changed over to the mode corresponding to the type of the signal.

The point of the present invention is that with respect to devices under test, not limited to a liquid crystal driver LSI, outputting various analog voltage values, in producing expected value voltage data in the tester, without transferring all output data produced to the expected value voltage generator, output data are produced and transferred at a given interval, and intermediate data between the output data are interpolated using the transferred output data by the operation inside the expected value voltage generator, so that desired expected value voltage data are produced.

Variations can be made to the extent not departing from the above point.

Figure 6:
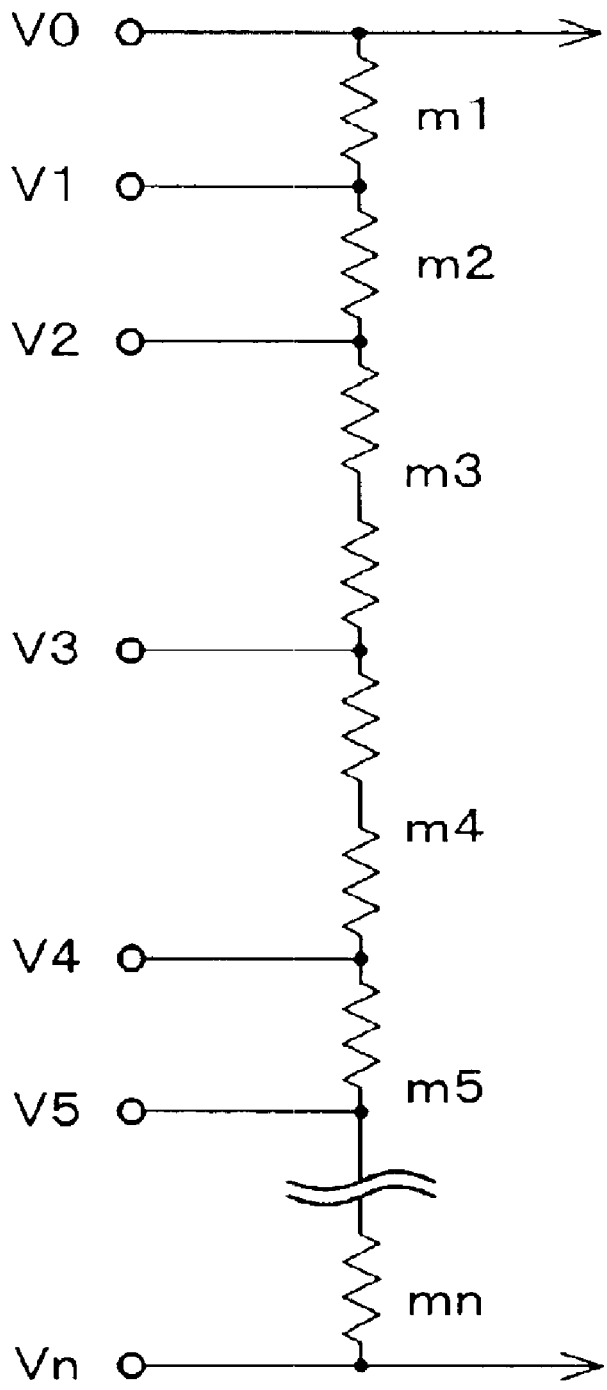
FIG. 6 is a circuit diagram showing one example of a ladder resistor.

The present embodiment focuses on the expected value voltage generator 13 in the system configuration example of FIG. 1. The expected value voltage generator 13 may be incorporated into the tester 12. Further, a semiconductor integrated circuit such as liquid crystal driver LSI 11 may incorporate the expected value voltage generator 13 with control means, storing means, operating means, and D/A converting means, instead of a ladder resistor as shown in FIG. 6, and incoming expected value data from outside is subjected to internal latching so that the integrated circuit can easily change various output characteristics. Thus, the present embodiment has a wide range of applications.

Incidentally, most commercialized liquid crystal driver LSI 11 among the liquid crystal drivers LSI 11 include a gray scale output characteristic corresponding to a predetermined γ characteristic of a liquid crystal panel. Meanwhile, a high-performance liquid crystal driver which can support plural types of γ characteristic which are provided so as to change a setting of γ characteristics for each chip has been proposed in order that just one type of liquid crystal driver can support plural types of liquid crystal panel.

However, in a test for such a high-performance liquid crystal driver, an operation time for an ideal voltage value is added to a test time, resulting in further increase in test time.

Here, a factor in the increase in test time for a high-performance liquid crystal driver will be explained below with reference to FIG. 5. FIG. 5(*a*) to (*c*) shows graphs of y characteristic examples of a liquid crystal panel. In FIG. 5, each vertical axis gives an output voltage value for gray scale display (1V to 6V) from a liquid crystal driver LSI to a liquid crystal panel, and each horizontal axis gives a gray scale level.

In the γ characteristic examples 1 and 2 shown in FIG. 5(*a*) and FIG. 5(*b*), respectively, there are 16-levels of gray scale between horizontal axes 1–2 (horizontal axes k–k+1), and for example, the total levels of gray scale between horizontal axes 1–5 are 64 levels. Further, a line between the horizontal axes 1–2 (horizontal axes k–k+1) indicates a linear characteristic, and a line from the horizontal axes 2 to 4 indicates a broken line characteristic.

The γ characteristic examples 1 and 2 indicates that these broken line characteristics are caused by a difference of liquid crystal panel and others.

Further, the −γ characteristic example 3 shown in FIG. 5(*c*) gives a relation between output voltage for gray scale display and gray scale level, including a finer broken line characteristic between the horizontal axes 1–2 (horizontal axes k–k+1).

In all of the above γ characteristic examples, the output voltage is produced by changing a reference voltage (see the ladder resistor in FIG. 6) externally inputted to the expected value voltage generator 13 of the liquid crystal driver LSI.

Thus, according to the characteristics of liquid crystal material and liquid crystal panel, γ characteristic is changed so as to be set corresponding to an optimum value in display quality level. Therefore, the value of output voltage for each gray scale level is determined (FIG. 6 gives an example of corresponding by a change in referred voltage) by the ladder resistor included in the liquid crystal driver. Inside a test program, the value of output voltage for each gray scale value is found by operation using a formula corresponding to a γ characteristic specification, and the value thus found is outputted as reference voltage value data from a testing device.

This reference voltage value data are inputted to the expected value voltage generator 13 and subjected to digital-to-analog conversion by a D/A converter inside the expected value voltage generator 13 to be outputted as a expected value voltage to the differential amplifier array module 14.

Conventionally, the γ characteristic and the number of gray scale levels are determined for each liquid crystal panel, and an output voltage is typically custom-generated by setting a ladder resistor's value inside the LSI shown in FIG. 6 (by setting a resistance value of the ladder resistor corresponding to the γ characteristic, without change a referred voltage)

Recently proposed liquid crystal driver is a high-performance liquid crystal driver capable of supporting plural types of liquid crystal panel by itself even in the case where the y characteristic changes to the γ characteristic 1 in FIG. 5(*a*) or the γ characteristic 2 shown in FIG. 5(*b*), or the case where the number of gray scale levels is changed as in the case of the γ characteristic 3 shown in FIG. 5(*c*), as described above.

In order to guarantee the output characteristics (acceptable value, uniformity) of the liquid crystal driver LSI having such a function, it is necessary to test all output conditions. Therefore, it is also necessary to carry out an output test with the change of γ characteristic.

This is also considered for the case of continuously testing different liquid crystal drivers LSI with respectively different γ corrections, using one and the same tester.

The conventional testing device for a semiconductor integrated circuit takes a method of causing a test program to operate a gray scale output voltage corresponding to γ characteristic, and causing a tester to output reference value data according to a result thus operated (It may be 1 ch in relation to I/O of a tester) so as to produce it as an expected value voltage in an expected value generating means. This method makes it impossible to readily output an expected value voltage, resulting in the increase in test time, tangled test program, and decrease in efficiency of development.

Also, the Increase in the amount of storage inside a tester is a problem.

Figure 10:
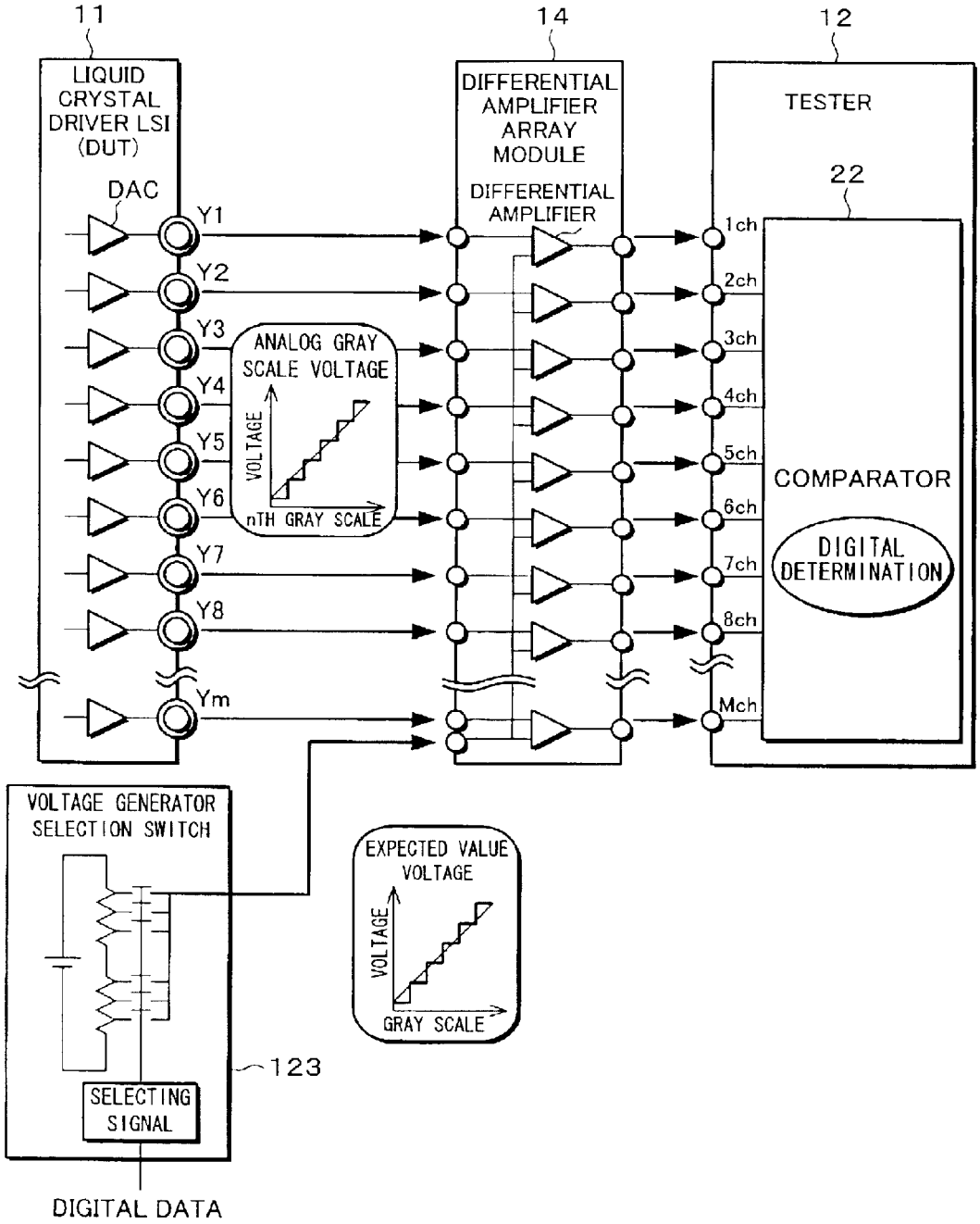
FIG. 10 is a block diagram schematically showing another conventional testing device for a semiconductor integrated circuit.

As described above, for the realization of a short test time in the conventional testing device for a semiconductor integrated circuit shown in FIG. 10, assuming the improvement in measurement accuracy and a liquid crystal driver which can support various γ characteristics by itself, an important point is how efficiently the reference voltage value can be generated for finding a difference from an output voltage of a liquid crystal driver.

In this respect, in the testing device for a semiconductor integrated circuit, shown in FIG. 1, the expected value voltage generator 13 can drastically reduce time when an expected value voltage is generated, so that it is possible to complete the test for the high-performance liquid crystal driver LSI as described above, with a high accuracy and short time.

Usually, in a test for a semiconductor integrated circuit such as liquid crystal driver LSI advancing for multiple outputs and multiple gray scale levels, it is possible to drastically reduce a test time by determining differentially amplified voltages in the comparator 22 at once. However, in the method of generating reference voltages corresponding to voltages for n-levels of gray scale, which are outputted from the liquid crystal driver LSI 11, in a tester and picking up this voltage every time a measurement is carried out, it takes several times as long as a test for measuring liquid crystal-system outputs, for the setting (transfer) of a reference voltage value.

However, according to the testing device for a liquid crystal driver of the present invention, the value of reference voltage is produced by interpolation in accordance with information on γ characteristic specifications of liquid crystal panel, such as the number of gray scale levels and the level number of gray scale display, which is taken in a memory. Therefore, this can reduce a transfer time more drastically than the conventional method in which the reference voltage value data generated in the tester is transferred to the voltage generator. As a result of this, it is possible to drastically reduce a test time.

Further, even in continuous tests for devices of respectively different γ characteristics, or in the case where the number of gray scale levels are increased to 256-levels, 1024-levels, for example, it is possible to readily generate a reference voltage corresponding to γ characteristic by interpolation. Therefore, even in such case, it is possible to carry out a test within a virtual determination time, without a necessity of considering a time for setting a reference voltage, and to suppress a tangled test program, thereby easily realizing a highly efficient test.

Further, with the advance of multiple gray scale levels, improvement in measurement accuracy is required. For example, a product with 1024-levels of grays scale requires a measurement accuracy at least within 1 mV. However, unlike the conventional technique, increase in the number of bits for reference value data does not drastically increase a test time. Further, in the present invention, the reference voltage is generated inside the expected value voltage generator 13, not the tester, thereby improving an accuracy of this voltage value. This enables a marked improvement in measurement accuracy in comparison with the conventional case where the reference voltage is generated in a tester or the like.

Note that, in the present embodiment, the explanation is based on the application of the present invention to the test for a liquid crystal driver LSI as a semiconductor integrated circuit. However, the present invention is not limited to this, and available for a device for generating multiple voltage values, enabling linear interpolation using a ladder resistor or the like, or a test for the same. Therefore, the present invention is applicable to a display device which carries out a gray scale display by changing a voltage value, and an output test for a D/A converter.

As described above, a reference voltage generating device of the present invention for generating a reference voltage in accordance with incoming reference data includes reference data producing means which produce reference data by interpolation in accordance with the incoming reference data so that the reference data are equal in number to the reference voltage, the incoming reference data being fewer in number than the reference voltage to be generated.

Therefore, by generating a required number of reference voltages from reference data fewer than the required number of reference voltages, it is possible to shorten a time for transfer of reference data to the reference voltage generating device in comparison with the case of transferring the reference data with the same number as a required number of reference voltages. This brings about an effect of reducing a time for the generation of reference voltage.

The interpolation of the reference data by the reference data producing means is preferably linear interpolation.

In this case, it is possible to use a ladder resistor or the like for the reference voltage generating device. This brings about an effect of interpolating the reference data with a simple arrangement.

The linear interpolation by the reference data producing means is carried out, for example, by the following interpolating means.

That is, the interpolating means include:

subtracting means for calculating a difference between the incoming reference data;

dividing means for dividing an output value from the subtracting means by a number of partitions between the incoming reference data;

multiplying means for multiplying an output value from the dividing means by a proportional value corresponding to reference voltage to be outputted; and adding/subtracting means for adding/subtracting an output value from the multiplying means with respect to the incoming reference data as an interpolating value.

This brings about an effect of efficiently carrying out the linear interpolation of the reference data by the interpolating means.

Further, a semiconductor integrated circuit, such as liquid crystal driver LSI, as device under test may incorporate the above-arranged reference voltage generating device.

This brings about an effect of using the conventional testing device for a semiconductor integrated circuit without change, i.e. a testing device which determines whether an output voltage is at a proper level by amplifying a difference between a reference voltage and a voltage for gray scale display.

Further, a testing device for a semiconductor integrated circuit of the present invention, which determines whether an output voltage of the semiconductor integrated circuit is at a proper level by comparison with a reference voltage separately generated, as described above, includes a reference voltage generating circuit for generating the reference voltage in accordance with incoming reference data, the reference voltage generating circuit producing reference data by interpolation in accordance with the incoming reference data so that the reference data are equal in number to the reference voltage, the incoming reference data being fewer in number than the reference voltage to be generated.

Therefore, the reduction of the time for the transfer of reference data to the reference voltage generating means reduces a time for obtaining an output voltage necessary for the test of the semiconductor integrated circuit. This can drastically reduce the time for the test of the semiconductor integrated circuit.

This can drastically reduce a transfer time of the reference data, in comparison with the case of transferring all of the reference data corresponding to a required number of reference voltage, even when the volume of reference data (the number of bits) is increased for the improvement in testing accuracy.

Therefore, in the case where the volume of reference data (the number of bits) required for the generation of reference voltage is increased for the improvement in testing accuracy, it is possible to create reference data required for the improvement in testing accuracy in a short time of period by generating reference data corresponding to the reference voltage inside the reference voltage generating device.

The above description brings about an effect of enabling an extremely short-time and highly accurate test for a semiconductor integrated circuit as a device under test.

The interpolation of the reference data by the reference voltage generating circuit is preferably linear interpolation.

In this case, it is possible to use a ladder resistor or the like for the reference voltage generating device. This brings about an effect of interpolating the reference data with a simple arrangement.

The interpolation of the reference data by the reference voltage generating circuit is carried out, for example, by the following interpolating means.

That is, the interpolating means include:

subtracting means for calculating a difference between the incoming reference data;

dividing means for dividing an output value from the subtracting means by a number of partitions between the incoming reference data;

multiplying means for multiplying an output value from the dividing means by a proportional value corresponding to reference voltage to be outputted; and adding/subtracting means for adding/subtracting an output value from the multiplying means with respect to the incoming reference data as an interpolating value.

This brings about an effect of efficiently carrying out the linear interpolation of the reference data by the interpolating means.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A reference voltage generating device for generating a reference voltage in accordance with incoming reference data, the reference voltage generating device including reference data producing means which produce reference data by interpolation in accordance with the incoming reference data so that the reference data are equal in number to the reference voltage, the incoming reference data being fewer in number than the reference voltage to be generated.

2. The reference voltage generating device according to claim 1, wherein the interpolation of the reference data by the reference data producing means is linear interpolation.

3. The reference voltage generating device according to claim 2, wherein the reference data producing means include interpolating means comprising:

subtracting means for calculating a difference between the incoming reference data;

dividing means for dividing an output value from the subtracting means by a number of partitions between the incoming reference data;

multiplying means for multiplying an output value from the dividing means by a proportional value corresponding to reference voltage to be outputted; and adding/subtracting means for adding/subtracting an output value from the multiplying means with respect to the incoming reference data as an interpolating value.

4. A semiconductor integrated circuit containing a reference voltage generating device for generating a reference voltage in accordance with incoming reference data, the reference voltage generating device including reference data producing means which produce reference data by interpolation in accordance with the incoming reference data so that the reference data are equal in number to the reference voltage, the incoming reference data being fewer in number than the reference voltage to be generated.

5. The semiconductor integrated circuit according to claim 4, wherein the interpolation of the reference data by the reference data producing means is linear interpolation.

6. The semiconductor integrated circuit according to claim 5, wherein the reference data producing means include interpolating means comprising:

subtracting means for calculating a difference between the incoming reference data;

dividing means for dividing an output value from the subtracting means by a number of partitions between the incoming reference data;

multiplying means for multiplying an output value from the dividing means by a proportional value corresponding to reference voltage to be outputted; and adding/subtracting means for adding/subtracting an output value from the multiplying means with respect to the incoming reference data as an interpolating value.

7. A testing device for a semiconductor integrated circuit, which determines whether an output voltage of the semiconductor integrated circuit is at a proper level by comparison with a reference voltage separately generated, the testing device including a reference voltage generating circuit for generating the reference voltage in accordance with incoming reference data, the reference voltage generating circuit producing reference data by interpolation in accordance with the incoming reference data so that the reference data are equal in number to the reference voltage, the incoming reference data being fewer in number than the reference voltage to be generated.

8. The testing device according to claim 7, wherein the interpolation of the reference data by the reference voltage generating circuit is linear interpolation.

9. The testing device according to claim 8, wherein the reference voltage generating circuit includes interpolating means comprising:

subtracting means for calculating a difference between the incoming reference data;

dividing means for dividing an output value from the subtracting means by a number of partitions between the incoming reference data;

multiplying means for multiplying an output value from the dividing means by a proportional value corresponding to reference voltage to be outputted; and adding/subtracting means for adding/subtracting an output value from the multiplying means with respect to the incoming reference data as an interpolating value.

10. The testing device according to claim 7, wherein the semiconductor integrated circuit is an integrated circuit for liquid crystal drive.

11. A testing method for a semiconductor integrated circuit, which determines whether an output voltage of the semiconductor integrated circuit is at a proper level by comparison with a reference voltage separately generated, the testing method comprising:

a reference data producing step of producing reference data by interpolation in accordance with incoming reference data which are fewer in number than the reference voltage to be generated so that the reference data are equal in number to the reference voltage; and a reference voltage generating step of generating the reference voltage in accordance with reference data thus obtained at the reference data producing step.

12. The testing method according to claim 11, wherein the interpolation of the reference data at the reference data producing step is linear interpolation.

13. The testing method according to claim 12, wherein the reference data producing step includes:

a first step of calculating a difference between incoming reference data;

a second step of dividing a value thus calculated at the first step by a number of partitions between the incoming reference data;

a third step of multiplying a value thus obtained at the second step by a proportional value corresponding to reference voltage to be generated at the reference voltage generating step; and a forth step of adding/subtracting a value thus obtained at the third step with respect to the incoming reference data as an interpolating value.

14. The testing method according to claim 11, wherein the semiconductor integrated circuit is an integrated circuit for liquid crystal drive.

* * * * *